United States Patent [19]

Radford

[11] Patent Number: 4,664,450

[45] Date of Patent: May 12, 1987

[54] HOLDER FOR A PICK, AND THE COMBINATION OF A PICK AND HOLDER

[75] Inventor: Leonard Radford, Sheffield, Great Britain

[73] Assignee: Padley & Venables Limited, Great Britain

[21] Appl. No.: 608,651

[22] Filed: May 9, 1984

[51] Int. Cl.[4] ..... E21C 35/2L

[52] U.S. Cl. ..... 299/81; 299/17

[58] Field of Search ..... 299/81, 17, 16; 175/393, 339, 340

[56] References Cited

U.S. PATENT DOCUMENTS

| | | | |
|---|---|---|---|
| 4,333,687 | 6/1982 | Barnstorf | 299/81 |
| 4,405,178 | 9/1983 | Brandenburg | 299/81 |
| 4,456,306 | 6/1984 | Wrulich et al. | 299/81 |
| 4,488,758 | 12/1984 | Clemmow et al. | 175/340 X |
| 4,583,786 | 9/1986 | Thorpe et al. | 299/81 |

FOREIGN PATENT DOCUMENTS

| | | | |
|---|---|---|---|
| 2104945 | 3/1983 | United Kingdom | 299/81 |

*Primary Examiner*—Stephen J. Novosad
*Assistant Examiner*—Thomas J. Odar
*Attorney, Agent, or Firm*—Wigman & Cohen

[57] ABSTRACT

A holder for a pick and the combination of a pick and holder.

The pick 1 has a shank 4 received in a socket 6 of a holder 2. The holder 2 carries in its socket 6 a tubular spigot 13 which mates in sealed manner with a coupling socket 15 in the pick shank to provide communication for water flow from a supply passage 16*a* through the pick 1 to outlet ports 12. A shoulder 8 on the spigot 13 abuts a sealing ring 18 in the coupling socket 15 to retain the pick in the holder and permit relative longitudinal displacement therebetween.

Carried by the tubular spigot 13 is a valve having an actuating rod 22 which extends through the bore of the spigot. A valve head 24 on the rod 22 is seatable on a shoulder 23*a* to close off water flow through the bore of the spigot. The end 26 of the rod 22 abuts the pick and during displacement of the pick into its holder in response to cutting engagement of the pick with the mineral, the valve head 24 is displaced to permit water flow to the ports 12. When the pick disengages from the mineral, water pressure on the pick and valve head 24 closes the valve head to seal against the shoulder 23*a.*

20 Claims, 7 Drawing Figures

HOLDER FOR A PICK, AND THE COMBINATION OF A PICK AND HOLDER

TECHNICAL FIELD AND BACKGROUND ART

This invention relates to pick holders and the combination thereof with picks and is particularly concerned with the art of mineral mining picks (which term, as is generally acknowledged in the art, includes picks for rock mining and road planing). In this art the pick holder is likely to be in the form of a socketed block or box on or in a driven component of a mining machine but may be the component itself.

The invention is concerned with picks and pick holders of the type in which, during their use, a fluid (usually water and conveniently referred to as such hereafter) is directed into the cutting region of the picks for the primary purposes of dust suppression, flushing and cooling (which latter term includes cooling incendive sparking). Examples of picks and pick holders of this general type are disclosed in our G.B. Specification No. 2,088,441 which is concerned with the way in which the flow of water under pressure can be achieved through the pick (for the aforementioned purposes) in an efficient manner. The advantages of providing a relatively simple and efficient means of achieving flow of water under pressure through a pick and the appropriate application of the resultant water spray or jet for the aforementioned purposes are discussed in our GB Specifications Nos. 2,088,441 and 82 03 638. It is most desirable that the water spray or jets emanating from the pick and pick holders are utilised efficiently and controlled to alleviate the presence of excessive water at the mineral mining site. With this in mind it has hitherto been proposed to incorporate in the mineral mining machinery valve means by which water supply for dust suppression, flushing or cooling is provided only when required for those purposes. In a conventional coal shearer drum the picks are secured in holding blocks which are helically spaced around the peripheral edge of a helical web or flange on the drum. During rotation of the drum for cutting, the picks are only in engagement with the mineral face for a minor arcuate portion of the drums rotation and in a prior proposal the valve means is incorporated in the drum to restrict the supply of water so that the spray or jets are provided only for those picks which at a given instant are passing through the aforementioned minor cutting arc. It has also been proposed to provide water sprays or jets from nozzles on picks and pick holders and to have valve means in the holder or carried by the pick which is responsive to pressure of cutting on the pick so that a water supply is available for the spray or jet on that pick or holder only for the period during which the pick is in cutting engagement with the mineral face; examples of these proposals are to be found in European Specifications Nos. 0 010 534 and 0 060 827 and in G.B. Specification No. 2,077,813 A.

The valve means in the prior proposals of the European Specifications are relatively complicated in operation and design, expensive to manufacture and assemble and because of their complicated structure (which calls for precision made valve components) will require frequent servicing and replacement. Where it is proposed that the valve means is carried by the pick (as in European No. 0 060 827) it will be realised, because of the limited useful working life expected for mineral mining picks, the aforementioned considerations of cost and complexity of design are likely to render the proposal particularly unattractive and unacceptable commercially.

The proposal in the aforementioned G.B. No. 2,077,813A is for a relatively simple form of valve means comprising a resilient sleeve on the pick shank which sleeve is deformed in response to cutting pressure on the pick to admit water to the nozzle. A necessary feature of this proposal is that the socket in the pick box which receives the pick shank is enlarged to permit the required deformation of the sleeve; this calls for expensive machining of the box and has the further disadvantage that the cavity within which the sleeve is received can collect coal (or like) dust which will impair the resilient deformation of the sleeve. There are the further disadvantages that the sleeve will likely have a very short useful life, will exhibit poor sealing characteristics, and may easily be damaged during handling of the pick and its insertion into the pick box by virtue of its exposed position on the pick shank.

It is an object of the present invention to provide a holder for a pick and the combination of a pick and holder which provides for water supply through the pick for dust suppression, flushing or cooling purposes during cutting and also provides a relatively simple, inexpensive and efficient means of controlling that water supply in a manner which alleviates the disadvantages of the aforementioned prior proposals.

STATEMENTS OF INVENTION AND ADVANTAGES

According to the present invention there is provided a holder for a mineral mining pick comprising a longitudinally extending shank socket within which a shank of a mineral mining pick is to be longitudinally received; a tubular spigot located within and extending longitudinally of said shank socket, said tubular spigot being carried at the inner end of the shank socket in fluid flow communication with a fluid supply passage and being intended for mating in fluid sealing engagement with a fluid coupling socket in the pick shank of a pick which is received in the shank socket for the supply of fluid to passage means in the pick for dust suppression, cooling or flushing purposes; and valve means for controlling fluid flow through said tubular spigot, said valve means comprising an actuator which is responsive to longitudinally directed forces applied thereto during use of the holder when holding a pick for mineral mining to open said fluid flow through the tubular spigot when said forces exceed a predetermined value.

Further according to the present invention there is provided the combination of a mineral mining pick and a pick holder, said pick comprising a body having a head with a cutting part, a shank which extends longitudinally from the head, a fluid coupling socket extending longitudinally of the shank and passage means in the body communicating with the coupling socket for the flow of fluid under pressure to an outlet port by which fluid is directed for dust suppression, cooling or flushing purposes; said pick holder comprising a shank socket within which the shank is longitudinally received, and a tubular spigot which extends longitudinally of the shank socket, the bore of said tubular spigot being in fluid flow communication with a fluid supply passage; said fluid coupling socket longitudinally receiving the tubular spigot during insertion of the shank into the shank socket to provide fluid flow communication between the fluid supply passage and the passage means; retaining means for releasably retaining the shank in the shank socket, and valve means associated with the tubular spigot for controlling fluid flow therethrough to the outlet port, said valve means comprising an actuator which is responsive to longitudinally directed forces applied to the pick during use of the combination in mineral cutting to open fluid communication through the valve means to the outlet port.

The present invention was primarily developed as an improvement to the invention which is the subject of our GB Specification No. 2,088,441 which is concerned with achieving a simple and efficient water coupling between a pick and its holder so that a water spray or jet can be effected through an outlet port in the pick body. By the present invention the tubular spigot/coupling socket water coupling of our earlier proposal may have associated therewith a relatively simple and efficient valve arrangement by which it is intended that water supply to the outlet port in the pick body should be effected substantially for the period during which the pick is in cutting engagement with the mineral face and should automatically be cut off as the pick moves out of cutting engagement with the mineral face. From the aforegoing it will be apparent that the actuator for controlling the valve means is intended to be responsive to the increased force to which the pick is subjected as it moves into engagement with the mineral face and cuts through that face so that the water supply is available at the jet or spray and upon removal or reduction of the aforementioned force (as the pick moves out of cutting engagement with the mineral) the actuator responds in the opposite sense so that the valve shuts off water flow to the jet or spray. Preferably the actuator is longitudinally displaceable in response to the aforementioned forces which are applied to the pick (and therethrough to the holder) during cutting and upon the reduction of those forces as the pick moves out of cutting engagement with the mineral face.

To apply the differential in forces to the actuator during a mineral cutting and non-cutting sequence, particularly where the actuator is longitudinally displaceable, it is preferred that the pick when received in the pick holder is capable of restricted longitudinal displacement relative to the holder so that relative longitudinal displacement between the pick and the pick holder causes a force differential to be applied to the actuator (preferably longitudinally displacing that actuator) to control the opening and closing of the valve means. Preferably therefore the means for retaining pick shank in the shank socket of the pick holder is arranged to permit the required relative longitudinal displacement between the pick and the holder for operation of the valve means. Several forms of retaining means can be provided as are well known in the art but preferably it is constructed so that a shoulder on the spigot engages with a resilient retaining component in the coupling socket to restrain withdrawal of the pick shank from the shank socket. Bearing in mind the aforementioned preference of the pick being longitudinally displaceable relative to the pick holder within predetermined limits as determined by the retaining means, biasing means should be provided which urges the pick outwardly from the socket in the pick holder to the extent permitted by the retaining means. By this latter proposal, when the pick engages the mineral face for cutting it is displaced into the shank socket of the holder under the cutting force (against the biasing means) and this displacement results in the valve means being adjusted to open communication for water flow through to the outlet port in the pick. The biasing means which urges the pick outwardly preferably comprises fluid pressure to which the pick is subjected from the holder. If required however the aforementioned biasing means can be provided by a spring component or other resilient means reacting between the pick and the pick holder.

If required, the tubular spigot can serve as the actuator which is responsive to a longitudinally directed force applied thereto during use of the pick/holder in mineral cutting to control operation of the valve means. .Preferably however the actuator is a component separate from the tubular spigot but which is conveniently housed in the bore of the tubular spigot to be subjected to the cutting and non-cutting forces as a result of which it is longitudinally displaceable to open and close the valve means. In a preferred arrangement the actuator compreses a rod-like component carried within the bore of the tubular spigot to extend therethrough so that one end of the actuator is subjected to the longitudinally directed forces applied between the pick and the pick holder upon and during cutting engagement of the pick with the mineral face and the subsequent clearance of the pick from the mineral face while the other end of the actuator adjusts a valve member which is displaceable in sympathy with the actuator to open or close the valve means between the outlet port and the water source depending upon the forces which are applied to the pick.

Where the pick and pick holder are capable of restricted longitudinal displacement relative to each other, it is likely that a longitudinally varying clearance will be provided between the opposing faces of the pick holder and the head of the pick and within which clearance detritus can collect (which would eventually prevent the aforementioned relative displacement). To alleviate this problem it is preferred that the pick head and pick holder are bridged by a seal such as a sleeve, "O" ring or similar component which effectively closes the aforementioned clearance to entry by detritus.

DRAWINGS

One embodiment of a mineral mining pick and a pick holder combination constructed in accordance with the present invention will now be described, by way of example only, with reference to the accompanying illustrative drawings, in which.

Figure 6:
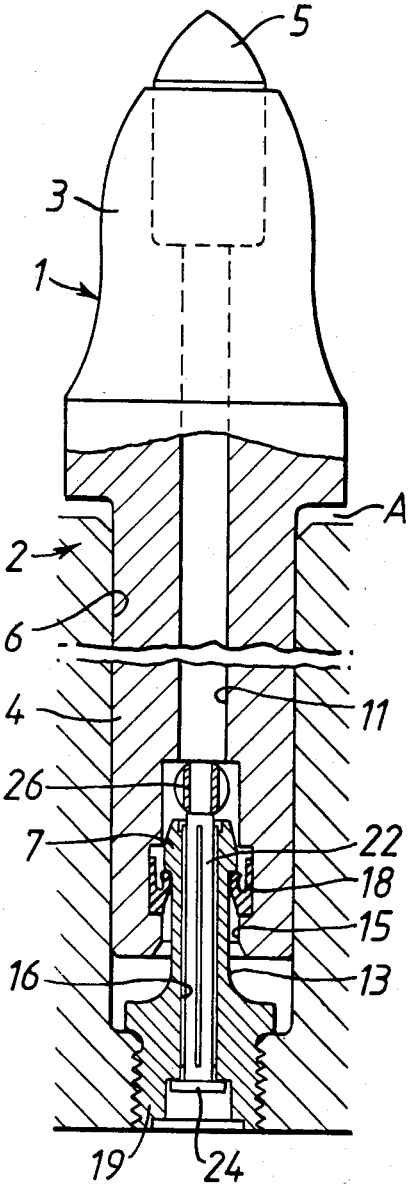
Figure 7:
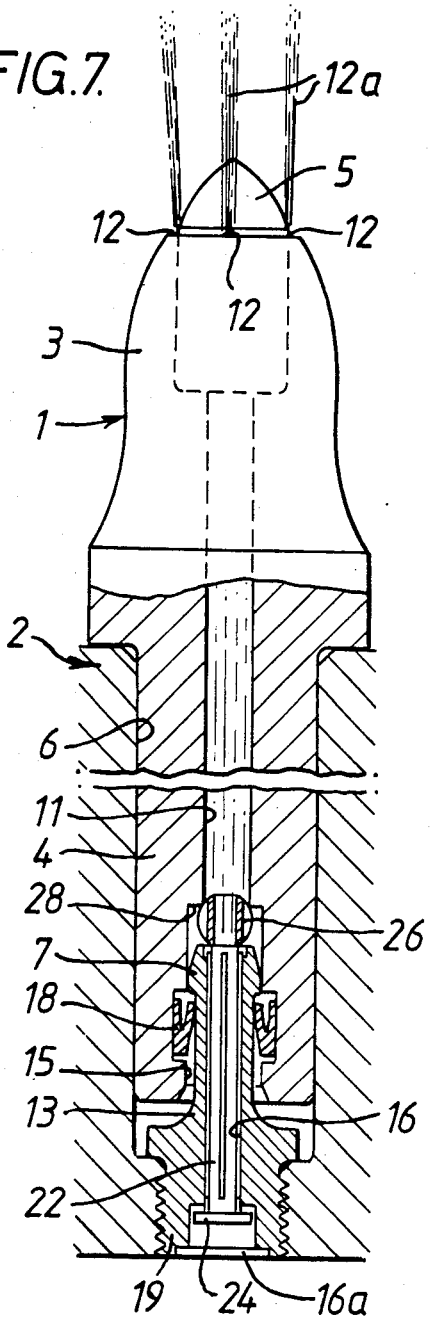

FIGS. 6 and 7 diagrammatically show the combination in conditions, respectively, in which fluid flow through the pick is closed by the valve means and is opened by the valve means.

DETAILED DESCRIPTION OF DRAWINGS

Figure 1:
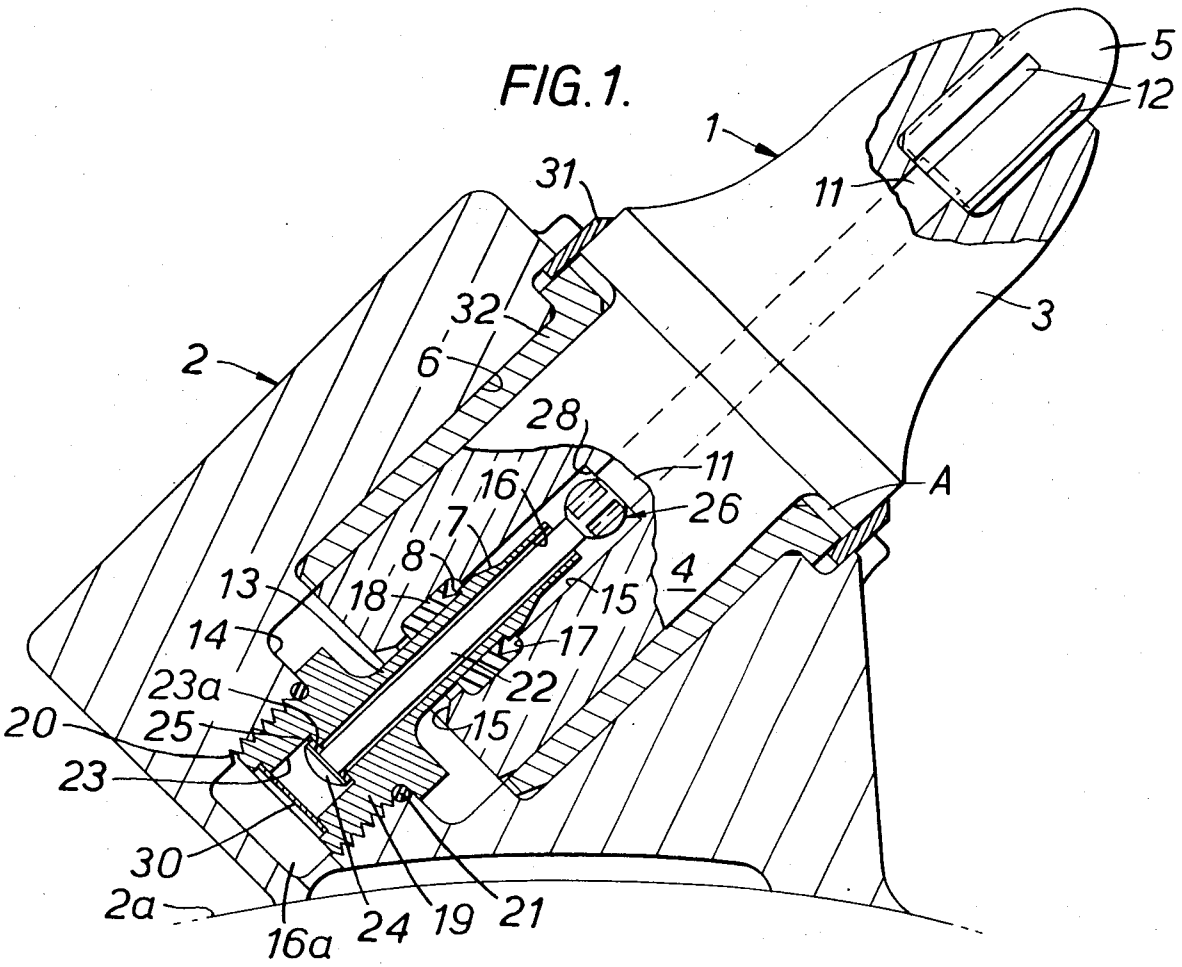
FIG. 1 is a side elevation of the combination in part section where a tubular spigot is carried by the pick holder and the valve means is carried by said tubular spigot.
Figure 2:
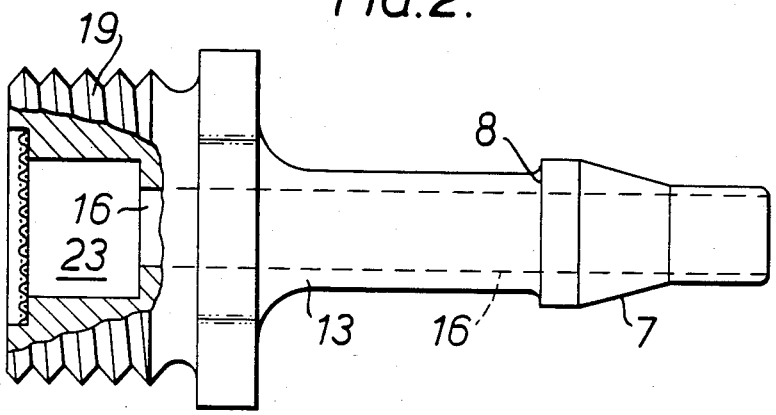
FIG. 2 is a side elevation in part section of the tubular spigot incorporated in the combination of FIG. 1.
Figure 3:
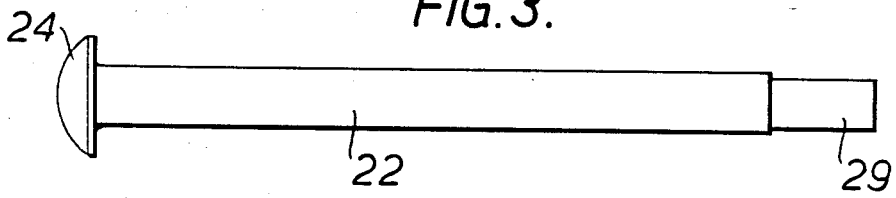
FIG. 3 is a side elevation of a rod part of the actuator for the valve means incorporated in the combination of FIG. 1.
Figure 4:
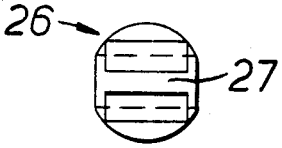
FIG. 4 is a side elevation of a flow distributor head for attachment to the rod part of FIG. 3.
Figure 5:
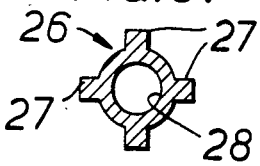
FIG. 5 is an end elevation of the distributor head shown in FIG. 4.

The combination shown in FIGS. 1, 6 and 7 is primarily intended for heavy duty coal cutting and comprises a point attack pick 1 mounted in a pick holder 2. The pick 1 is generally of conventional shape comprising a one piece steel body having a head 3 and a shank 4 which extends longitudinally from the head 3. The shank 4 may be of any lateral cross section but will usually be polygonal, rectangular or, as considered in the present embodiment, circular. Mounted in the head 3 is a tungsten carbide insert 5 which forms a cutting part or tip to the pick. Provided in the holder 2 is a cylindrical shank socket 6 which receives the cylindrical shank 4 in substantially complementary manner, the shank being inserted longitudinally into the socket 6 through the mouth thereof.

The pick holder 2 will usually be in the form of a block or box as shown which is secured for movement as part of a coal cutting machine to displace the cutting tip 5 as appropriate for coal cutting. Usually the holder 2 will be secured to a coal shearer drum 2*a* which is rotatable about its longitudinal axis to effect cutting with the pick 1 retained in the holder to project outwardly of the drum at a calculated angle of attack to the coal face. If required, the holder 2 can be an integral part of the drum 2*a*.

Formed within the body of the pick 1 is a passage 11 which extends longitudinally through the shank 4 and into the head 3 where it communicates with outlet ports 12 formed between recesses in the side face of the insert 5 and an opposing face of a bore within the head 3 within which bore the insert 5 is mounted (preferably in accordance with the invention which is the subject of our GB Specification No. 2,087,949). The passage 11 is intended for the flow therethrough of water which is primarily intended for the purposes of dust suppression, flushing and cooling during coal cutting. Generally the water will emanate from a source within the coal shearer drum 2*a* and consequently provision is made within the pick holder 2 for coupling the water supply to the passage 11. This coupling includes a tubular spigot 13 upstanding from the bottom wall 14 of the socket 6 and concentric with that socket. The spigot 13 is received within a water coupling socket 15 which is formed in the free end of, and concentric with, the pick shank 4 and which is an extension of the passage 11. The bore 16 of the tubular spigot communicates with the passage 11 and comprises part of a water supply passage 16*a* from the source of water under pressure within the drum 2*a*. Located within an annular recess 17 in the socket 15 of the pick shank is an annular pressure seal/-retainer component 18 of resilient material. The recess 17 provides a convenient means for retaining the component 18 longitudinally in the socket 15 for carriage with the pick but it will be appreciated that alternative means of such retention can be provided. The component 18 forms a water seal between the tubular spigot 13 and the pick shank 4 and also serves as part of retaining means by which the pick shank 4 is retained in its socket 6. It will be realised from the drawing that the tubular spigot 13 will automatically mate with the fluid coupling socket 15 and pass through the sealing component 1B to effect the water seal as the shank 4 is inserted longitudinally into the shank socket 6.

A further part of the aforementioned retaining means is provided by a frusto conical head 7 of the tubular spigot 13, the taper of which provides a lead-in surface during mating of the spigot with the socket 15 and the movement of the head of the spigot through the sealing-/retaining component 18. The head 7 has an annular shoulder B which, when the spigot 13 is fully inserted into the coupling socket 15 lies adjacent to the component 18 (as shown in FIG. 1) so that abutment of this component against the shoulder 8 restrains the pick 1 from being withdrawn from the pick holder 2. When the pick 1 is inserted to its maximum extent in the holder 2 a longitudinal clearance is provided between the shoulder 8 and the resilient component 18 so that this clearance can be taken up to permit relative longitudinal displacement between the pick and its holder (which longitudinal displacement will be slightly increased by a small amount of deformation of the resilient component 18 during its abutment by the shoulder 8) so that a gap or clearance A will open and close between the end face of the pick holder 2 and an annular face which opposes it on the pick head 3 which is formed between the pick head and the shank 4 (see FIGS. 6 and 7). The retaining means provided by the shoulder 8 on the tubular spigot 13 and the resilient sealing/retaining component 18 permits the pick 1 to be removed from the holder 2 by the application of an excessive longitudinally directed force to the pick which is sufficient to move the shank 4 off the spigot 13 by resilient deformation of the component 18 (and possibly removing that component from the socket 15).

The tubular spigot 13 is integral with a tubular mounting 19 by which it is carried in the holder 2. The mounting 19 has a male thread which engages with a female threaded bore 20 in the holder, the bore 20 being an extension of the water supply passage 16*a*. An annular seal 21 is provided between a shoulder of the mounting 19 and the bottom wall 14 of the shank socket.

The spigot 13/mounting 19 component carries a valve which controls the supply of water from the passage 16*a* to the passage 11 and thereby to the outlet ports 12; this valve comprises a longitudinally extending actuator in the form of a rod 22 mounted within the bore 16 of the spigot. Sufficient clearance is provided to ensure that the rod 22 and spigot are displaceable longitudinally relative to each other and that an adequate flow of water is permitted between the bore 16 and the opposing surface of the rod 22. The rod 22 emerges from the tubular spigot 13 into an enlarged bore part 23 of the tubular mounting 19 and carries a valve head 24 and sealing washer 25 within this bore part 23. By longitudinal displacement of the valve head 24 with the rod 22 so that the washer 25 is urged into abutment with a bottom shoulder 23*a* in the tubular mounting 19, a water seal is provided between the bore part 23 and the bore 16 of the tubular spigot (thereby closing water communication between the passages 16*a* and 11). The rod 22 extends from the bore of the spigot 13 into the coupling socket 15 and has fitted thereto a retaining head 26 provided with longitudinally extending external splines 27. The head 26 is intended to abut an annular shoulder 28 at the bottom of the socket 15 to cause displacement of the rod 22 in a sense (downwardly as shown in FIG. 7) which lifts the valve head 24 off the shoulder in the mounting 19 to open water communication between the passages 16*a* and 11. During abutment between the rod retaining head 26 and the shoulder 28 in the pick shank, the splines 27 ensure that water flow communication is maintained between the socket 15 and the passage 11. The head 26 conveniently has a bore 28 by which it is fitted and secured to a complementary end 29 of the rod 22 following insertion of the rod through the tubular spigot.

If required, the mouth of the bore 23 to the tubular mounting 19 can be provided with a water filter 30.

In use of the combination shown in FIG. 1 a supply of water under pressure is provided to the supply passage 16*a* and the water pressure provides a biasing force on the valve head 24 and on the pick 1. More partioularly (see FIG. 6) the water pressure urges the valve head 24 into sealing engagement with the shoulder 23*a* in the mounting 19 while the rod 22 is urged longitudinally so that its head 26 abuts the shoulder 28 in the coupling socket of the pick shank. This latter abutment applies a biasing force to the pick to urge it longitudinally in a direction outwardly of the shank socket 6. In addition, the rotation of the coal shearer drum can provide a centrifugal biasing force which also urges the pick to be displaced in a direction outwardly of the shank socket 6. Because of the aforementioned biasing forces it will be appreciated that when the pick 1 is out of cutting engagement with a mineral face, the pick will be displaced outwardly from its holder 2 to provide a maximum clearance A and to an extent permitted by the abutment of the shoulder 8 on the tubular spigot against the resilient sealing/retaining component 18 as shown in FIG. 6. In this latter condition the valve head 24 will be fully seated and sealed in the tubular mounting 19 to close water flow communication between the bore part 23 and the spigot bore 16 so no water jets or spray emanate from the outlet ports 12. As the pick 1 moves into cutting engagement with the mineral face, the forces to which it is subjected during such cutting will cause the pick to be displaced longitudinally into its holder 2 to take up the clearance A as shown in FIG. 7. During this latter displacement the abutment of the shoulder 28 on the retainer head 26 causes the rod 22 to be displaced longitudinally in sympathy with the pick 1 thereby lifting the valve head 24 from its seating in the mounting 19; the valve is consequently opened and immediately permits the flow of water from the supply passage 16*a*, through the spigot bore 16 and passage 11 to provide water jets or sprays 12*a* at the outlet ports 12 for flushing, cooling or dust suppression purposes. Although during the opening of the valve to permit water flow the valve head 24 (and immediately the valve head 24 has lifted from its seating), the pick 1 will be subjected to a biasing effect provided by the water pressure in the passage 11 and on face 28, the cutting force applied to the pick during its engagement with the mineral face will be considerably greater than this biasing force so that the valve will open immediately as effective mineral cutting commences. Following a cutting stroke of the pick, and as the pick moves out of cutting engagement with the mineral face, the removal of the cutting forces will again permit the pick to be displaced outwardly from its holder 2 by the previously discussed biasing forces and to the condition shown in FIG. 6 so that the valve head 24 can again seat against the shoulder 23*a* of the mounting 19 to close the valve and cut-off the water supply to the outlets 12.

During the opening and closing of the clearance A it is possible that detritus may enter this clearance and eventually prevent the pick from exhibiting the longitudinal displacement relative to the pick holder which is required to open and close the valve. To alleviate this possibility a cylindrical sleeve 31 can be provided to bridge the pick head 3 and the pick holder and to cover the clearance A.

During use the shank socket 6 can be subjected to considerable wear so if required the socket 6 may be provided with a replaceable lining such as a sleeve 32 (conveniently formed as a moulding in plastics material). The sleeve 32 is a substantially complementary fit within the shank socket 6 to be readily removable therefrom and receives the shank 4 in substantially complementary manner. Naturally the sleeve 32 will be subjected to wear during use of the pick 1 and when necessary it can be replaced at relatively little expense. As shown in FIG. 1 the bridging sleeve 31 is conveniently clamped between the replaceable sleeve 32 and the body of the pick holder but if required the sleeves 31 and 32 can be integral. It will be realised that the sleeves 31 and 32 are optional and accordingly have been omitted from FIGS. 6 and 7. It will also be realised that one or more outlet ports which communicate with the passage 11 can be positioned where required on the pick head and other than as indicated by the ports 12.

I claim:

1. A holder for a mineral mining pick comprising a longitudinally extending shank socket within which a shank of a mineral mining pick is to be longitudinally received; a tubular spigot located within and extending longitudinally from a bottom wall of said shank socket, said tubular spigot being secured directly to the bottom wall of the shank socket and having a longitudinally extending bore in fluid flow communication with a fluid supply passage in the holder and being intended for mating in fluid sealing engagement with a longitudinally extending fluid coupling socket in the pick shank of a pick which is slidably received in the shank socket for the supply of fluid through said bore to passage means in the pick for dust suppression, cooling or flushing purposes; valve means for controlling fluid flow through the bore of said tubular spigot, said valve means comprising longitudinally extending rod means mounted in the bore of said tubular spigot and longitudinally displaceable relative thereto to open and close fluid flow through said bore, said rod means being responsive to longitudinally directed forces applied thereto from a pick held by the holder during use for mineral mining to open said fluid flow through the bore when said forces exceed a predetermined value.

2. A holder as claimed in claim 1 in which one end part of said rod means extends from the tubular spigot remote from the bottom wall and is intended to be subjected to longitudinally directed forces applied from the pick during use of the holder and the other end part of said rod means controls adjustment of the valve member for opening and closing the valve means.

3. A holder as claimed in claim 1 in which the tubular spigot is removable from the shank socket through the mouth thereof and during such removal the spigot carries with it said valve means.

4. A holder as claimed in claim 1 in which said valve means is biased by fluid pressure in said fluid supply passage in a sense to close fluid flow through said tubular spigot.

5. A holder as claimed in claim 1 in which the tubular spigot has an enlarged head part remote from the inner end of the shank socket for retaining a pick in the shank socket.

6. The combination of a mineral mining pick and a pick holder, said pick comprising a body having a head with a cutting part, a shank integral with the head part and which extends longitudinally from the head, a fluid coupling socket extending longitudinally within the shank from the end thereof remote from the head and passage means in the body communicating with the coupling socket for the flow of fluid under pressure to an outlet port by which fluid is directed for dust suppression, cooling or flushing purposes; said pick holder comprising a shank socket within which the shank is longitudinally received, and a tubular spigot located within said shank socket and extending longitudinally from a bottom wall of the shank socket, said tubular spigot being secured directly to the bottom wall of the shank socket and having a longitudinally extending bore in fluid flow communication with a fluid supply passage in the holder; said fluid coupling socket longitudinally receiving the tubular spigot during insertion of the shank into the shank socket to provide fluid flow communication through the bore of the tubular spigot and between the fluid supply passage and the passage means; retaining means for releasably retaining the shank in the shank socket, and valve means for controlling fluid flow through the bore of the tubular spigot, said valve means comprising longitudinally extending rod means mounted in the bore of the tubular spigot and longitudinally displaceable relative thereto to open and close fluid flow through said bore, said rod means being responsive to longitudinally directed forces applied to said rod means from the pick during use of the combination in mineral cutting to actuate the valve means and open fluid communication through the bore when said forces exceed a predetermined value.

7. The combination as claimed in claim 6 in which said valve means is biased by fluid pressure in said fluid supply passage in a sense to close fluid communication through the bore of the tubular spigot.

8. The combination as claimed in claim 6 in which the rod means has one end part remote from the bottom wall of the shank socket which is subjected to the longitudinally directed forces applied between the pick and the pick holder upon and during cutting engagement of the pick with the mineral face and the subsequent clearance of the pick from the mineral face while the other end part of the rod means controls adjustment of a valve member to open or close the valve means.

9. The combination as claimed in claim 8 in which the valve member is carried by the rod means.

10. The combination as claimed in claim 6 in which the pick is capable of restricted longitudinal displacement relative to the pick holder and said relative displacement causes a force differential to be applied to the rod means to control the opening and closing of the valve means.

11. The combination as claimed in claim 10 in which biasing means is provided by which the pick shank is urged outwardly of the shank socket to an extent where the pick is restrained by said retaining means, said pick shank being displaceable inwardly relative to the shank socket and against fluid pressure biasing means by cutting engagement of the pick with mineral.

12. The combination as claimed in claim 11 in which the biasing means is intended to be provided by the pressure of fluid to which the combination is subjected.

13. The combination as claimed in claim 6 in which the retaining means comprises an external shoulder on the tubular spigot which shoulder is longitudinally spaced from and directed towards the bottom of the shank socket and a resilient retainer carried by the coupling socket said retainer engaging over said shoulder of the spigot during insertion of the shank into the shank socket to retain the shank in its socket.

14. The combination as claimed in claim 13 in which the shoulder is formed by a head part of the spigot, said head part being tapered to provide a lead-in surface for mating the spigot with the coupling socket.

15. The combination as claimed in claim 14 in which the head part is frusto conical and the external shoulder thereon is annular and engages in abutment with the resilient retainer.

16. The combination as claimed in claim 13 in which the resilient retainer comprises a ring member and means is provided for retaining said ring member longitudinally within the coupling socket.

17. The combination as claimed in claim 13 in which the resilient retainer comprises a fluid seal between the tubular spigot and its coupling socket.

18. The combination as claimed in claim 6 in which the tubular spigot is screw threadedly mounted in the holder to be removable therefrom through the mouth of the shank socket and the valve means is carried by the spigot to be removable therewith from the pick holder.

19. The combination as claimed in claim 10 in which a shoulder is formed between the pick head and the shank and a seal is provided between the pick holder and the pick head, said seal bridging a clearance which opens and closes between said shoulder and the pick holder during longitudinal displacement of the pick relative to its holder to alleviate the entry of detritus into said clearance.

20. The combination as claimed in claim 19 in which said seal between the pick holder and pick head is an extension of a replaceable lining provided in the shank socket and within which lining the pick shank is received.

* * * * *